US007641056B2

(12) United States Patent
Schulman

(10) Patent No.: US 7,641,056 B2
(45) Date of Patent: Jan. 5, 2010

(54) DESKTOP ORGANIZER

(76) Inventor: Carl H. Schulman, 60237 Prickly Pear La., La Quinta, CA (US) 92253

( * ) Notice: Subject to any disclaimer, the term of this patent is extended or adjusted under 35 U.S.C. 154(b) by 18 days.

(21) Appl. No.: 11/550,772

(22) Filed: Oct. 18, 2006

(65) Prior Publication Data

US 2007/0102376 A1 May 10, 2007

Related U.S. Application Data

(60) Provisional application No. 60/730,214, filed on Oct. 25, 2005.

(51) Int. Cl.
*B42F 17/00* (2006.01)

(52) U.S. Cl. ..... 211/11

(58) Field of Classification Search ..... 211/11, 211/10, 13.1, 70.6, 71.01, 74, 87.01, 189, 211/195, 72, 113, 85.15; D19/92, 75; 206/482, 206/493, 465, 466; D9/415
See application file for complete search history.

(56) References Cited

U.S. PATENT DOCUMENTS 1,495,189 A * 5/1924 Mack ..... 224/42.33
1,671,293 A * 5/1928 Jennens ..... 248/231.71
2,981,583 A * 4/1961 Eisenberg ..... 312/140.4
3,517,822 A * 6/1970 Wagner ..... 211/11
3,532,318 A * 10/1970 Lloyd ..... 248/311.2
4,176,743 A * 12/1979 Fitzpatrick ..... 206/214
4,542,832 A * 9/1985 Minick et al. ..... 211/106
D281,299 S * 11/1985 Esslinger ..... D6/491
4,586,618 A * 5/1986 Norman ..... 211/133.3
4,606,523 A * 8/1986 Statz et al. ..... 248/311.2
4,612,863 A * 9/1986 Vonhausen et al. ..... 108/28
4,802,593 A * 2/1989 Romanos ..... 211/10
4,828,120 A * 5/1989 Beil et al. ..... 211/88.01
4,836,403 A * 6/1989 Blackmon ..... 220/737
D309,839 S * 8/1990 Newhouse ..... D6/491
D309,848 S * 8/1990 Sokolski et al. ..... D7/620
D311,829 S * 11/1990 Vossoughi ..... D6/418
D311,833 S * 11/1990 Newhouse ..... D6/484
D318,269 S * 7/1991 Hassel et al. ..... D13/155
D321,011 S * 10/1991 Blossom ..... D19/78
5,197,614 A * 3/1993 Dalton et al. ..... 211/133.2
D342,173 S * 12/1993 Kirchner et al. ..... D6/511
5,335,797 A * 8/1994 Myers ..... 211/50
D351,860 S * 10/1994 Kirchner et al. ..... D19/92
D353,159 S * 12/1994 Kirchner et al. ..... D19/92
D363,492 S * 10/1995 Brussing ..... D14/251
5,547,088 A * 8/1996 Belokin et al. ..... 211/87.01
5,601,193 A * 2/1997 Santoya ..... 211/11
5,775,521 A * 7/1998 Tisbo ..... 211/94.01
5,911,178 A * 6/1999 Alexander ..... 108/50.11
5,971,171 A * 10/1999 Thorp et al. ..... 211/128.1

(Continued)

*Primary Examiner*—Sarah Purol
(74) *Attorney, Agent, or Firm*—The Belles Group, P.C.

(57) ABSTRACT

An embodiment of an organizer for a desk or other horizontal surface having an extending portion includes an elongated base assembly having a clamping member and a cover member for attaching to the extending portion, at least one fastening device for attaching the clamping member to the surface and for attaching the cover member to the clamping member, a pair of vertical supports adapted to be attached to the cover member and each support including a plurality of holes, and a plurality of horizontal accessory supporting rods extending from the slots in one of the vertical supports to the corresponding holes in the other vertical support.

19 Claims, 10 Drawing Sheets

U.S. PATENT DOCUMENTS 5,974,985 A * 11/1999 Flototto et al. ..... 108/157.18
6,119,992 A * 9/2000 Stuart ..... 248/231.71
6,152,311 A * 11/2000 German ..... 211/86.01
6,170,410 B1 * 1/2001 Gioacchini et al. ..... 108/153.1
D445,456 S * 7/2001 Saylor et al. ..... D19/75
6,332,407 B1 * 12/2001 Vardaro ..... 108/50.01
D453,794 S * 2/2002 Saylor et al. ..... D19/75
D456,182 S * 4/2002 Hamilton et al. ..... D6/491
6,435,461 B1 * 8/2002 Saylor et al. ..... 248/231.71
6,550,875 B1 * 4/2003 Compton et al. ..... 312/196
6,568,335 B2 * 5/2003 Hamilton et al. ..... 108/50.02
6,578,498 B1 * 6/2003 Draudt et al. ..... 108/50.02
6,648,390 B1 * 11/2003 Yang ..... 294/161
6,766,912 B1 * 7/2004 Gibbs ..... 211/74
6,792,876 B2 * 9/2004 Lin ..... 108/50.01
6,968,957 B2 * 11/2005 Fynn ..... 211/11
7,121,030 B2 * 10/2006 Schneider ..... 40/661
7,185,767 B2 * 3/2007 Phillips ..... 211/11
7,273,152 B1 * 9/2007 Kahn ..... 211/11
7,357,086 B2 * 4/2008 Petrick et al. ..... 108/50.02
D589,728 S * 4/2009 Shaha et al. ..... D6/510

* cited by examiner

DESKTOP ORGANIZER

RELATED APPLICATION

This application claims priority to U.S. provisional patent application, entitled DESKTOP ORGANIZER, Application No. 60/730,214, filed Oct. 25, 2005.

FIELD OF THE INVENTION

The present invention relates in general to a desktop organizer, and more particularly relates to a desktop organizer attached to a desk and capable of holding a multitude of items that normally clutter up a desk.

BACKGROUND ART

This section describes the background of the disclosed embodiment of the present invention. There is no intention, either express or implied, that the background art discussed in this section legally constitutes prior art.

Many people work at desks that are cluttered with so much stuff that they have very little working space. The desktop may contain a computer monitor, a keyboard, a mouse, other computer related items, a telephone, in/out baskets, books, files, notepads, pens, pencils, a stapler, and other office supplies. Some desktop organizers provide a place to put some of these items, but they rest on the desktop consuming valuable work space. Other organizers are mounted on a wall, but not all desks are located close enough to a wall for the organizer to be convenient.

A few desktop organizers are attached to the desktop and provide storage above the desktop. Some of these organizers require damaging the desktop, such as drilling a hole in or driving a screw into it, to mount them to the desktop. Other organizers include a pair of legs that are clamped to an overhanging portion of the desktop to support the organizing device. These organizers are very limited in the amount of material that can be stored on them due to this method of support.

BRIEF DESCRIPTION OF THE DRAWINGS

The features of this invention and the manner of attaining them will become apparent, and the invention itself will be best understood by reference to the following description of certain embodiments of the invention taken in conjunction with the accompanying drawings, wherein.

CERTAIN EMBODIMENTS OF THE INVENTION

Figure 1:
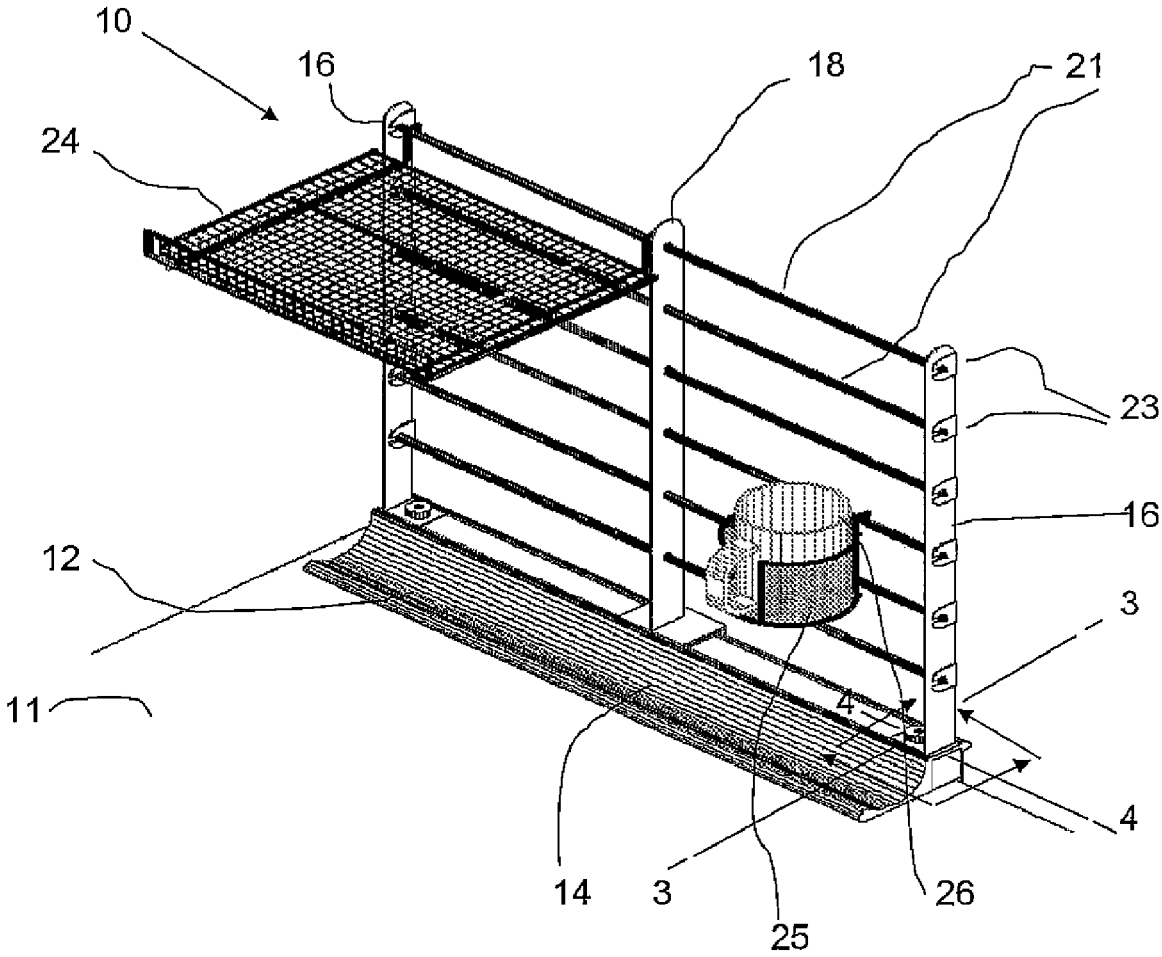
FIG. 1 is a perspective view of an embodiment of the desktop organizer of the present invention mounted on a desktop.

It will be readily understood that the components of the embodiments as generally described and illustrated in the drawings herein, could be arranged and designed in a wide variety of different configurations. Thus, the following more detailed description of the embodiments of the system, components and method of the present invention, as represented in the drawings, is not intended to limit the scope of the invention, as claimed, but is merely representative of certain embodiments of the invention.

An embodiment of an organizer for a desk or other horizontal surface having an extending portion includes an elongated base assembly having a clamping member and a cover member for attaching to the extending portion, at least one fastening device for attaching the clamping member to the surface and for attaching the cover member to the clamping member, a pair of vertical supports adapted to be attached to the cover member and each support including a plurality of holes, and a plurality of horizontal accessory supporting rods extending from the slots in one of the vertical supports to the corresponding holes in the other vertical support.

According to another embodiment of the invention, there is provided an organizer for a desk having an extending desktop portion. The organizer may include an elongated base member, at least one fastening device for attaching the elongated base member to the extending desktop portion, a pair of vertical supports adapted to attached to the base member, a plurality of rods attached to the vertical supports, and at least one organizing accessory having a pair of hooks for hanging the accessory from one of the rods.

According to yet another embodiment of the invention, there is provided an organizer for a surface having an extending portion. The organizer may include a pair of vertical supports adapted to be attached to the extending desktop portion, a plurality of rods attached to the vertical supports, and at least one organizing accessory having a pair of hooks for hanging the accessory from one of the rods.

Referring now to FIG. 1 of the drawings, there is shown a perspective view of a desk organizer in accordance with an embodiment of the present invention. The desk organizer 10 may include a base assembly 12 attached to a desktop 11. The base assembly 12 may support a pair of end vertical supports 16 and a center vertical support 18.

Figure 5:
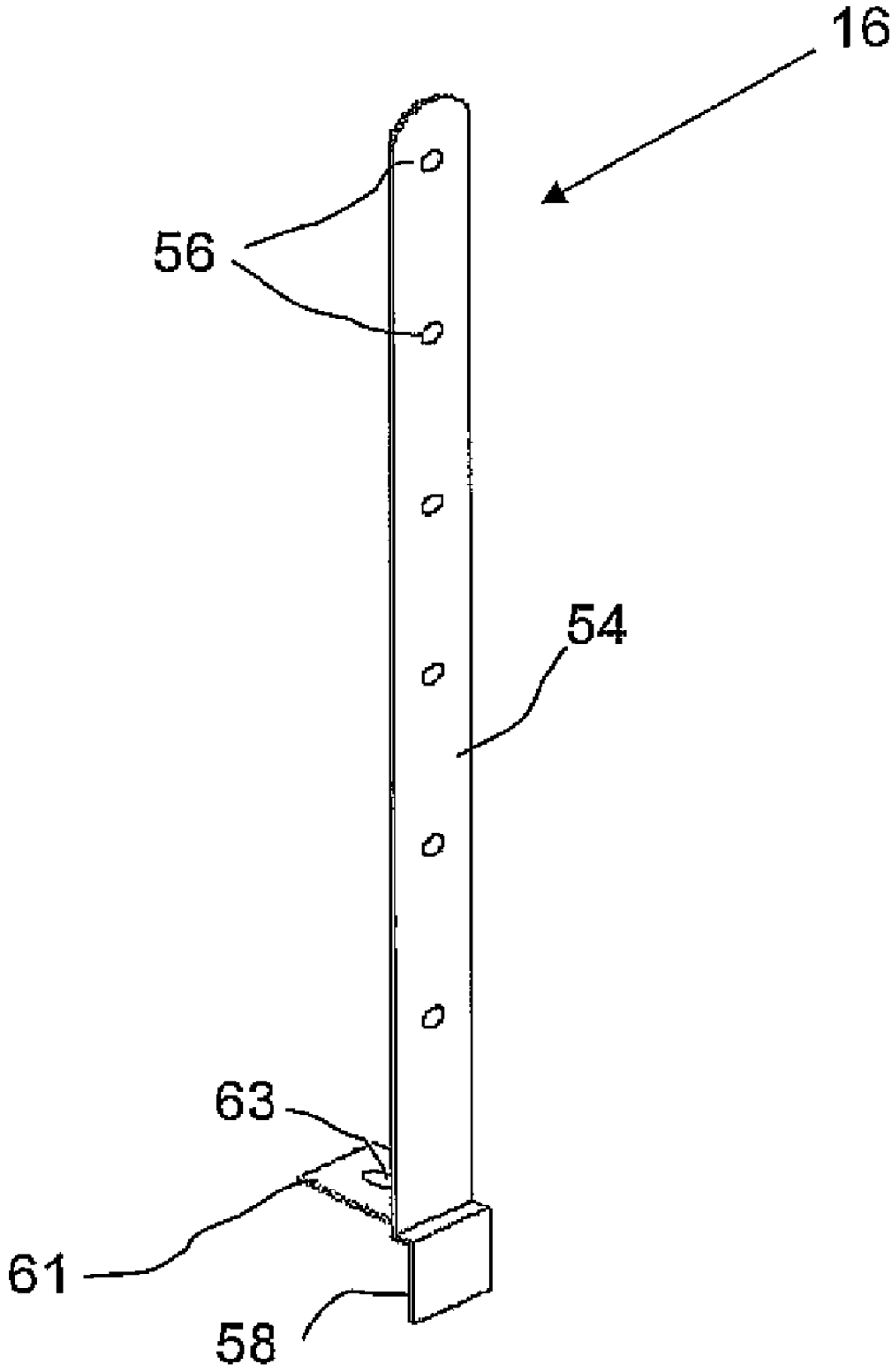
FIG. 5 is a perspective view of the end vertical support of the desktop organizer of FIG. 1.
Figure 6:
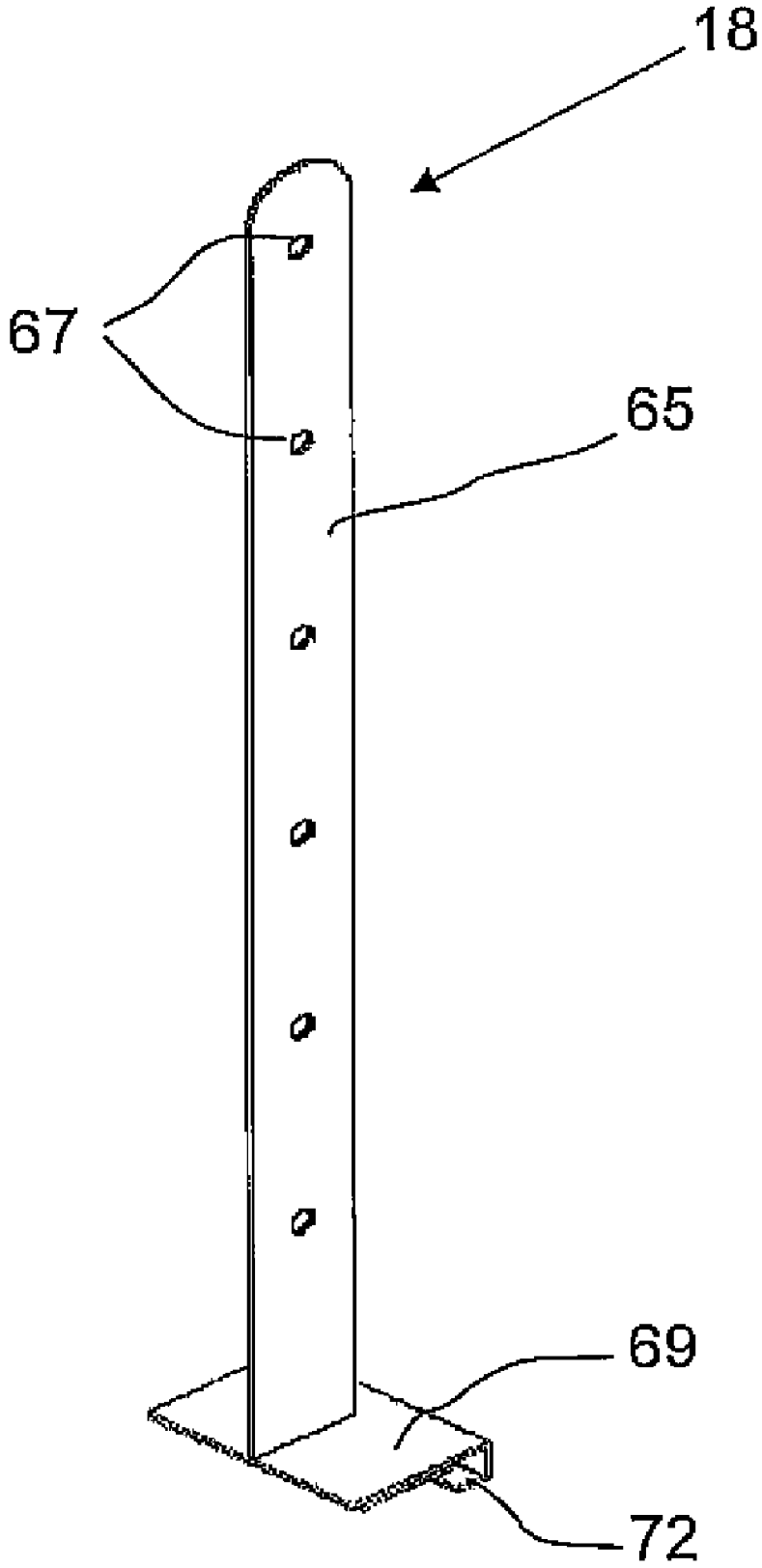
FIG. 6 is a perspective view of the center vertical support of the desktop organizer of FIG. 1.

As shown in FIG. 5, the end vertical support 16 may include a vertical member 54 having a plurality of evenly-spaced holes 56, an offset member 58, and a horizontal tab 61 having an elongated hole 63. As shown in FIG. 6, the center vertical support may include a vertical member 65 having a plurality of evenly-spaced holes 67 and a base 69 having a hook portion 72.

The end vertical supports 16 and center vertical support 18 may support a plurality of parallel rods 21 for attaching organizing accessories. The rods 21 may be positioned through the corresponding holes 56 and 67 in end vertical supports 16 and center vertical support 18, respectively, and secured to the end vertical supports 18 with a plurality of retainer clips 23. The organizing accessories may include a shelf 24 and a cup holder 25 for holding a cup 26. Various other organizing accessories may include, but are not limited to, a letter holder, a file sorter, a book/magazine holder, a basket, an organizer basket, a CD holder, and a pencil holder.

Depending upon the overall length of the desk organizer and the accessories utilized (i.e. weight to be supported), the center vertical support may not be necessary. The length of the desk organizer may vary from less than one foot to greater than two feet. Multiple desk organizers may be used together to increase the storage capabilities. The desk organizer may also used with any other horizontal surface, not only a desktop, where additional storage is desired.

Figure 2:
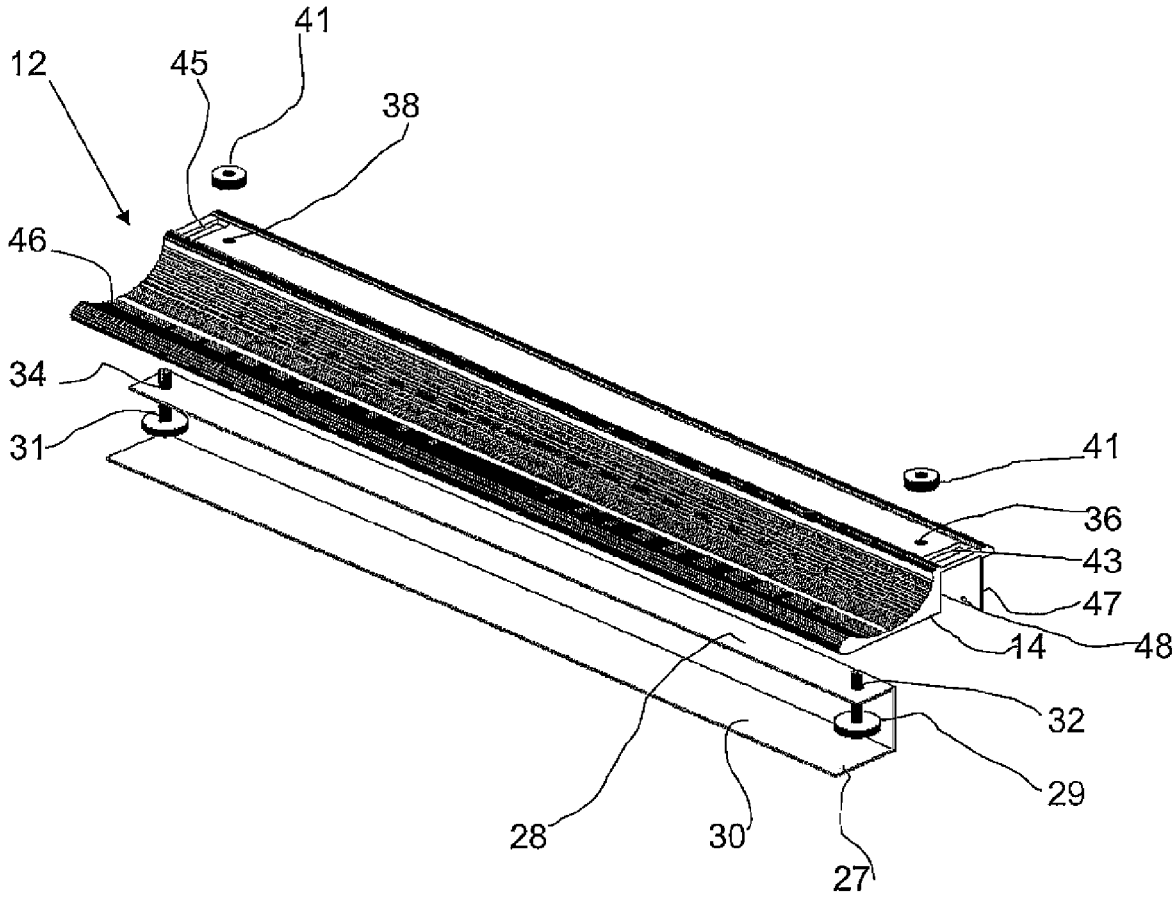
FIG. 2 is a exploded view of the base assembly of the desktop organizer of FIG. 1.

Referring now to FIG. 2, there is shown an exploded view of the base assembly 12. The base assembly 12 may include a clamping member 27 that attaches to the desk and a cover member that attaches to the clamping member 27 on the desktop. The clamping member 27 may include an upper horizontal portion 28 and a lower horizontal portion 30. Elevator bolts 29 and 31 may extend through holes 32 and 34, respectively, in the upper horizontal portion 28 of the clamping member 27 and holes 36 and 38, respectively, in the cover member 14 to allow the clamping member 27 to be attached to the desk and the cover member 14 to be attached to the clamping member 27 using nuts 41, such as acorn nuts or other suitable nuts. Other bolts having a large flat bottom surface may be used in place of the elevator bolts. The cover member 14 may further include openings 43 and 45 for the insertion of a portion of the end vertical supports.

Figure 3:
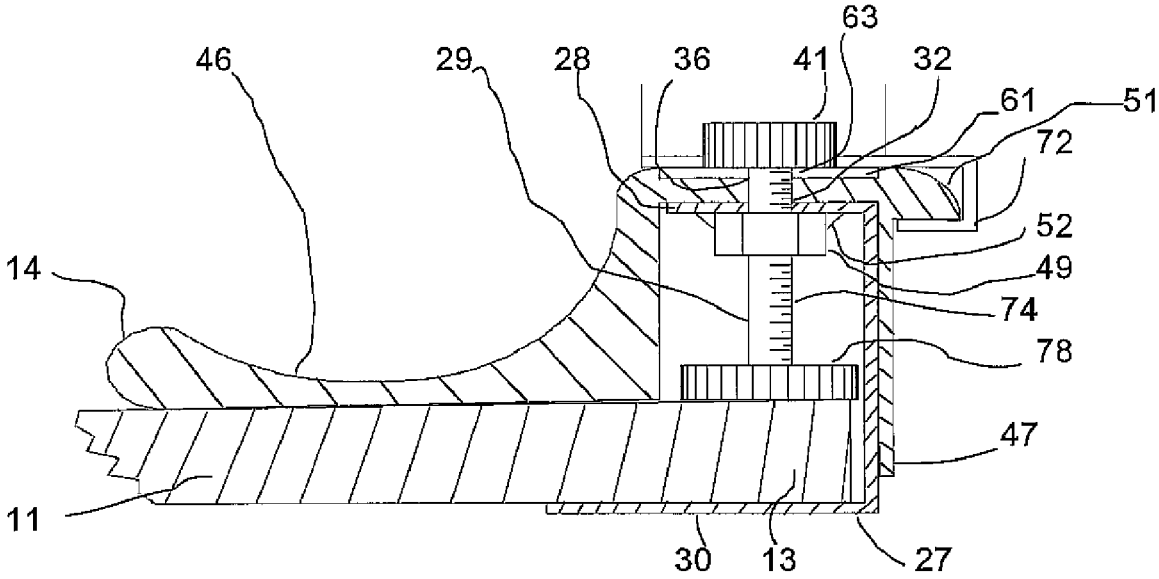
FIG. 3 is a sectional view of the base assembly through line 3-3 of FIG. 1.
Figure 4:
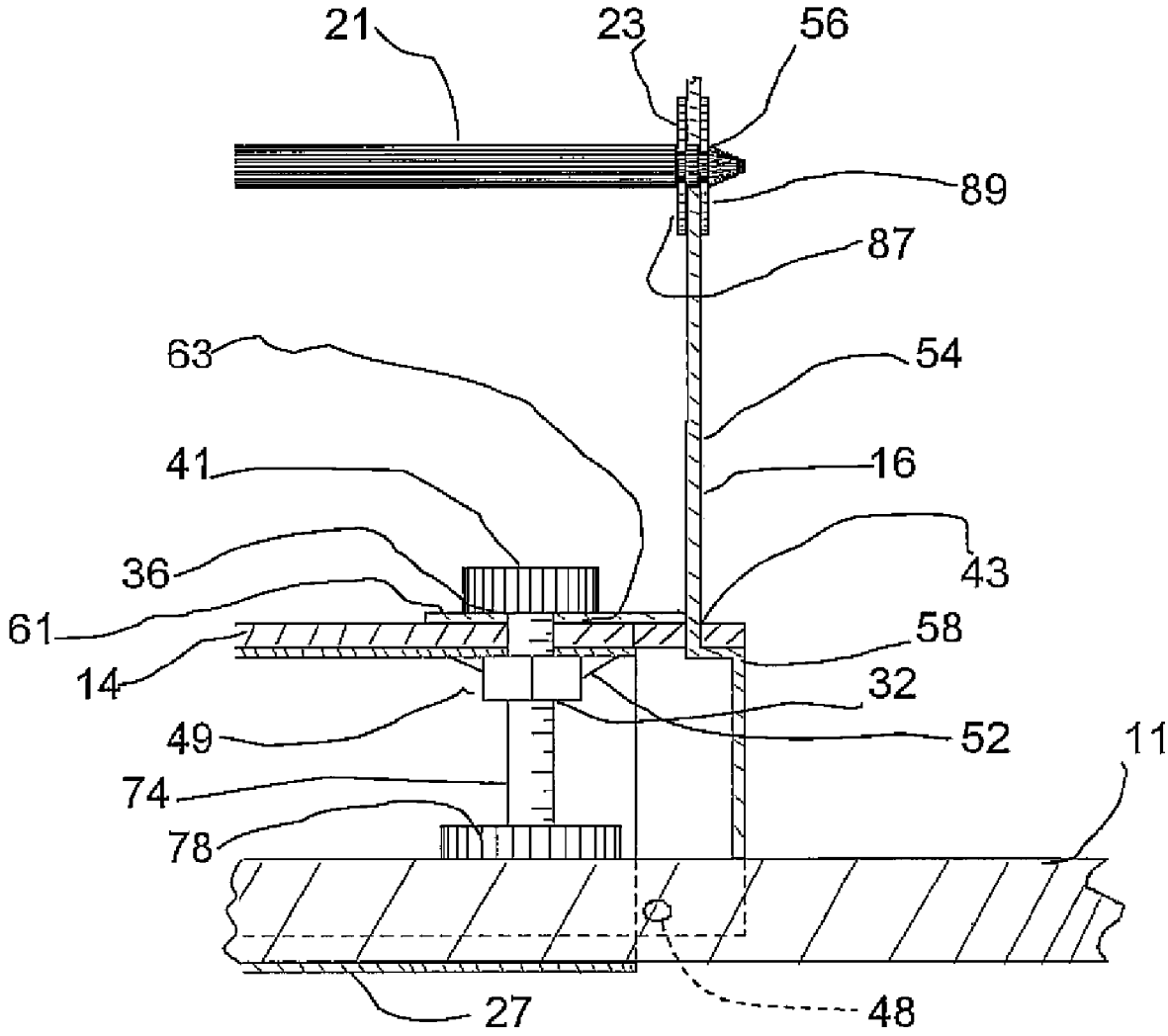
FIG. 4 is a sectional view of the base assembly through line 4-4 of FIG. 1.
Figure 9:
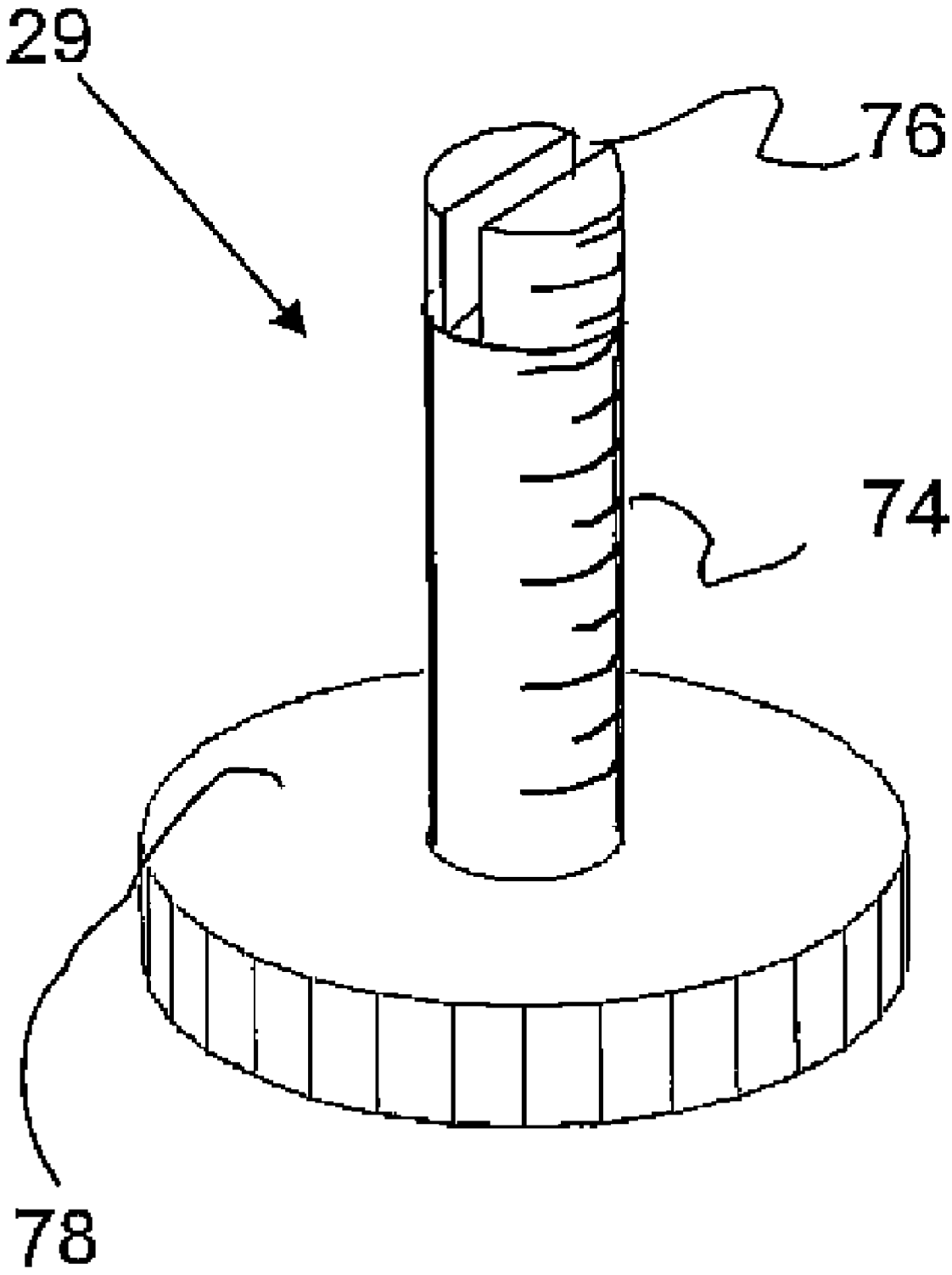
FIG. 9 is a perspective view of the elevator bolt of the base assembly of FIG. 2.

Referring now to FIGS. 3 and 4, there are shown sectional views of the base assembly 12 of FIG. 1. The clamping member 27 may be attached to an extending portion 13 of desktop 11 using the elevator bolt 29, which may include a threaded portion 74, a base 76, and a slotted top 76 (FIG. 9). A nut 49 may be welded to the bottom side of the upper horizontal portion 28 around the hole 32 for engaging the threaded portion 74 of elevator bolt 29 to allow the tightening of base 76 to the extending portion 13 of the desktop 11.

An upper portion of the elevator bolt 29 including the slotted end may extend through the hole 36 in the cover member 14 and an elongated hole 63 in a horizontal tab 61 on the end vertical support 54 (FIG. 5). The nut 41 may secure the cover member 14 and the end vertical support 54 to the clamping member 27.

A front portion 46 of the cover member 14 may include a well for storing pens, pencils, or other small desk items and may provide additional support to prevent the desk organizer from leaning forward when holding a substantial load. A back portion 47 of the cover member 14 may extend down farther than the top of the desktop 11 to conceal a substantial part of the clamping member 27. An extending lip 51 along the back of the cover member 14 may engage a hook portion 72 of the center vertical support 18. The back portion 47 may include at least one hole or opening 48 to receive a screw or other fastening device (not shown) to fix the portion 47 to the desktop 11. In this manner, optionally the clamping member need not be employed.

The offset member 58 of the end vertical support 16 may be insert through the opening 43 in the cover member 14 to dispose the horizontal tab 61 adjacent to the top of the cover member 14 with the elevator bolt extending through the elongated hole 63 in the horizontal tab 61. The offset member 58 may cover an open side of the cover member at least partially concealing the clamping member 27 and elevator bolt 29.

Figure 7:
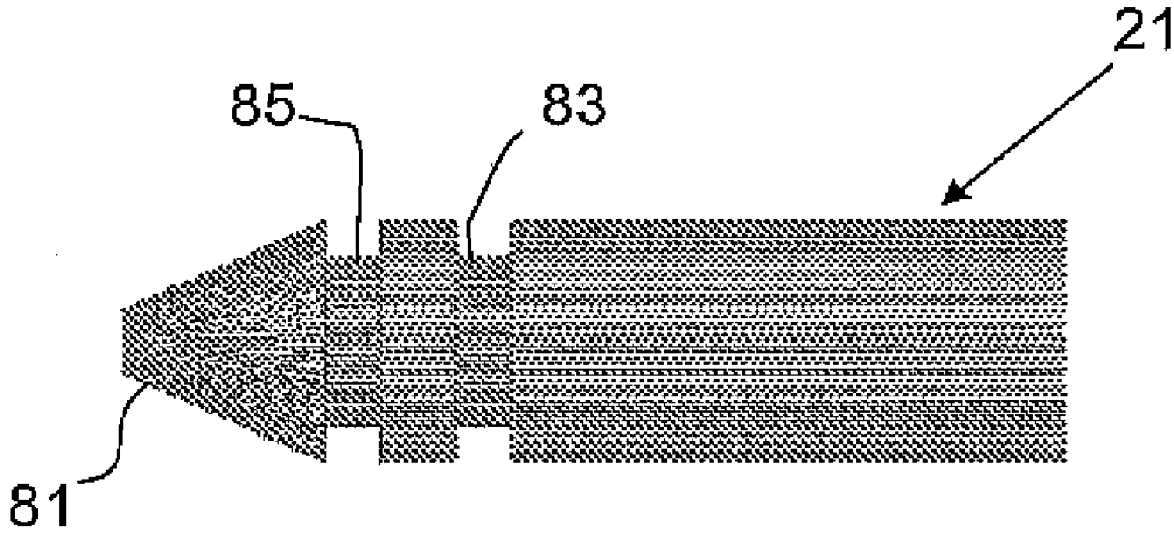
FIG. 7 is a partial enlarged view of one of the rods of the desktop organizer of FIG. 1.
Figure 8:
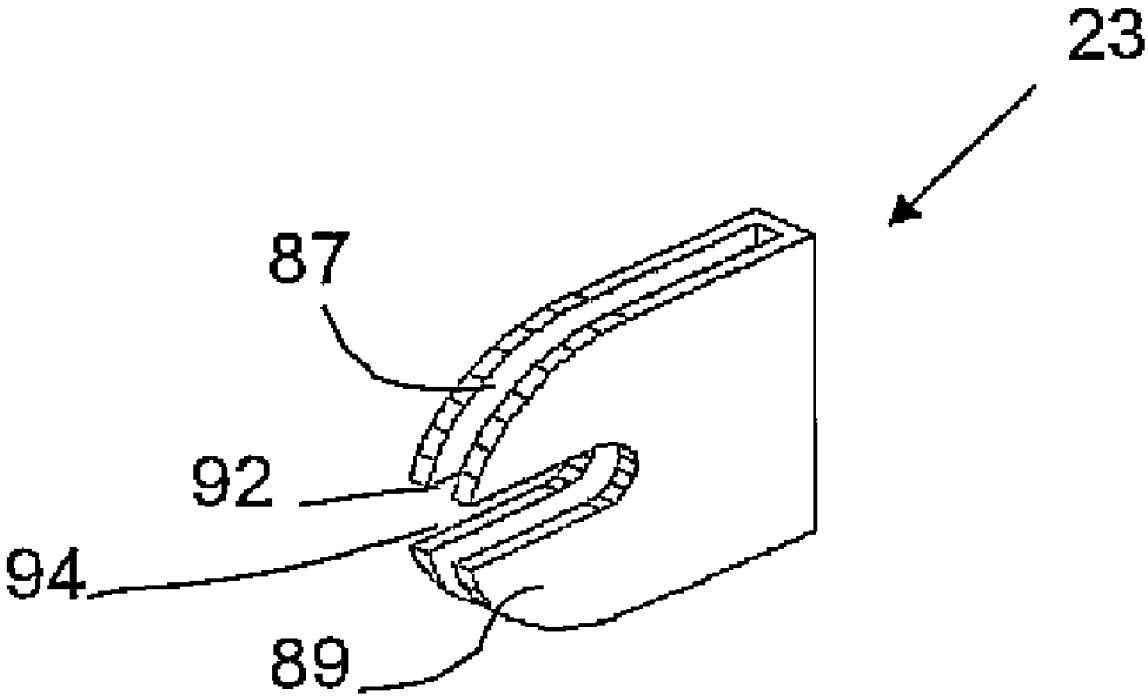
FIG. 8 is a perspective view of one of the clips used to hold the rods to the end vertical supports of the desktop organizer of FIG. 1.

One of the rods 21 may be inserted through one of the holes 56 in the vertical member 54 of the end support rod 16. The rod 21 may be secured to the vertical member 54 using sides 87 and 89 of one of the retainer clips 23. As shown in FIG. 7, each end 81 of the rod 21 may include a pair of grooves 83 and 85. The grooves 83 and 85 may be engaged with the slots 92 and 94 in the sides 87 and 89, respectively, of the retainer clip 23 as shown in FIG. 8.

Figure 10:
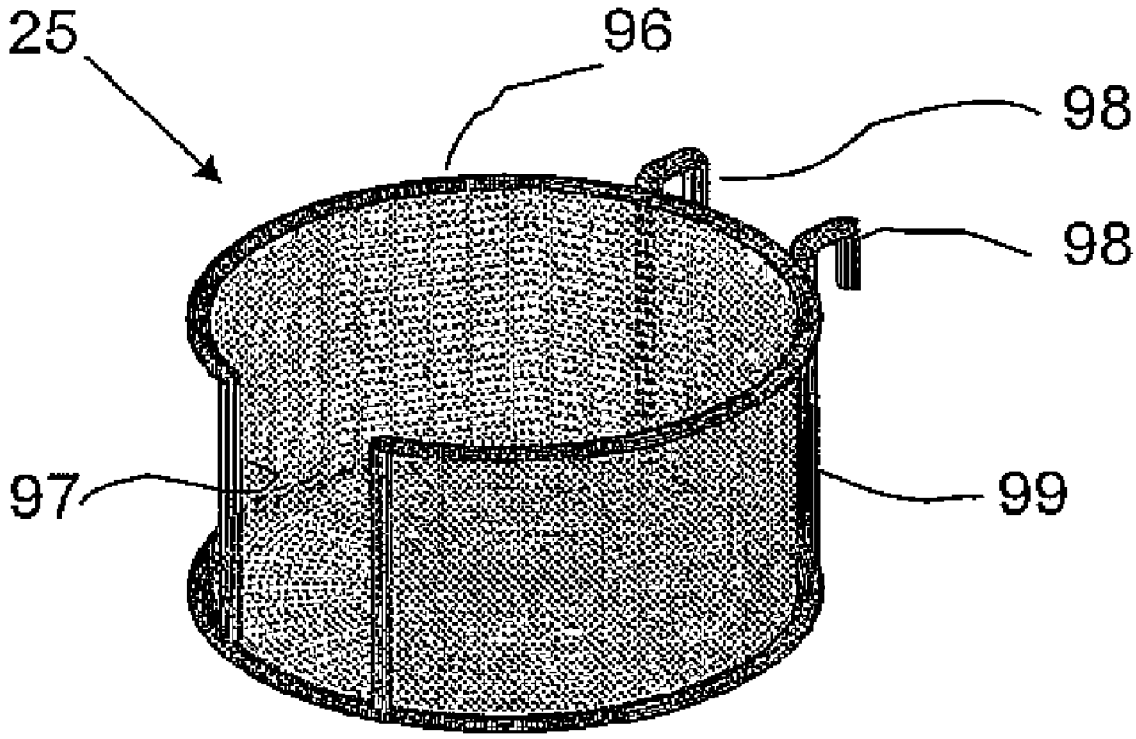
FIG. 10 is a perspective view of the cup holder shown in FIG. 1.

Referring now to FIG. 10, there is shown a perspective view of one of the organizing accessories. The cup holder accessory 25 may include a cylindrical body 96 having a cup handle opening 97 to allow accommodation of a cup with a handle as shown in FIG. 1. A pair of hooks 98 may be attached to the back of the cylindrical body 96 to allow attachment of the cup holder accessory 25 to one of the rods 21 of the desktop organizer 10.

Each organizing accessory may include a pair of hooks. If the width of the accessory is less than the distance between adjacent vertical supports (i.e. the cup holder accessory 25 in FIG. 1), the hooks may each include a vertical rod portion 99 having a length which may be greater than the distance between two adjacent horizontal rods to hold the accessory in an upright position. Alternatively, at least one vertical member (not shown) separate from the hooks may be employed to serve the same function as the hook portions 99. If the width of the accessory is greater than the distance between adjacent vertical supports (i.e. the shelf accessory 24 in FIG. 1), the length of the hooks may be less than the distance between two adjacent rods since the vertical supports may hold the accessory in an upright position.

To install the desktop organizer, the clamping member may be disposed around any extending portion of a desktop. The bases of the elevator bolts may be lowered using a screwdriver in the slotted top to firmly clamp the desktop between the lower horizontal member of the clamping member and the bases of the elevator bolts. The cover member may then be placed over the clamping member with the slotted tops of the elevator bolts extending through the holes in the cover member.

The offset members 58 of the end vertical supports may next be inserted through the openings in the cover member, so that the offset members may cover the open sides of the cover member and the horizontal tabs may be adjacent to the top of the cover member with the slotted tops extending through the elongated holes in the horizontal tabs. A nut may be used on each extending top of the elevator bolts to secure the cover member and the end vertical supports to the clamping member. If, for example, the desk organizer is approximately 24 inches long, a center vertical support may be attached to the cover member using a lip on the back side of the cover member and a hook portion on the center vertical support.

A plurality of rods may then be placed through the evenly spaced holes in the vertical supports. The ends of the rods including a pair of grooves may be secured to the end vertical supports using a plurality of retainer clips or other suitable method, such as rods with threaded ends used with nuts, to achieve a strong rigid connection. The rods may also be provided permanently attached to the vertical supports by welding or other appropriate method of attachment. The desired organizing accessories may now be installed on the parallel vertical rods.

The embodiment described above has the advantage of a sturdy base and sturdy vertical supports to allow much greater loads to be placed on the desktop organizer. Shelves on this organizer may be capable of holding twenty pounds or more in actual models which have been constructed and tested.

While particular embodiments of the present invention have been disclosed, it is to be understood that various different modifications and combinations are possible and are contemplated within the true spirit and scope of the disclosed embodiments. There is no intention, therefore, of limitations to the exact disclosure herein presented.

What is claimed is:

1. An organizer to be secured to a desired surface having an extending portion comprising:

a base assembly comprising:

an elongated clamping member extending from a first end to a second end, the elongated clamping member having an upper portion, a lower portion and a channel between the upper portion and the lower portion, the upper portion comprising a first threaded hole located at the first end of the elongated clamping member and a second threaded hole located at the second end of the elongated clamping member;

the extending portion of the desired surface slidably inserted into the channel of the elongated clamping member;

a first bolt extending through and theadily engaging the first threaded hole and a second bolt extending through and theadily engaging the second threaded hole, the first and second bolts extending into the channel so as to compress the the extending portion of the desired surface between the lower portion of the elongated clamping member and the first and second bolts;

an elongated cover member having a rear portion, a forward portion and a channel in the rear portion, the elongated cover member positioned atop the desired surface so that the upper portion of the elongated clamping member nests within the channel of the elongated cover member and the forward portion contacts the desired surface so as to provide support to prevent the organizer from leaning forward, the first and second bolts extending through holes in the elongated cover member and extending upward from a top surface of the elongated cover member;

first and second supports, each of the first and second supports comprising a vertical member, a horizontal tab having a hole and extending from the vertical member, a plurality of spaced-apart holes along the vertical member;

the first support positioned so that the first bolt extends through the hole of the horizontal tab of the first support, the vertical member of the first support extending upward from the elongated cover member;

the second support positioned so that the second bolt extends through the hole of the horizontal tab of the second support, the vertical member of the second support extending upward from the elongated cover member;

a plurality of rods, each rod horizontally extending from one of the spaced-apart holes in the first support to a corresponding one of the spaced-apart holes in the second support; and first and second nuts threadily respectively engaging the first and second bolts so as to fasten the first and second supports, the elongated cover member and the elongated clamping member together.

2. The organizer of claim 1 wherein the first and second threaded holes of the top portion of the elongated clamping member are formed by first and second nuts rigidly secured to the top portion of the elongated clamping member.

3. The organizer of claim 1 wherein as the first and second nuts are tightened to fasten the first and second supports, the elongated cover member and the elongated clamping member together, the compression of the the extending portion of the desired surface between the lower portion of the elongated clamping member and the first and second bolts is increased.

4. The organizer of claim 1 wherein each of the first and second supports further comprise an offset member that is substantially parallel to and offset from the vertical member, the offset members of the first and second supports substantially enclosing open ends of the channel of the elongated cover member.

5. The organizer of claim 1 wherein the elongated cover member further comprises a first slot and a second slot, the first and second supports extending through the first and second slots of the elongated cover member respectively.

6. The organizer of claim 1 wherein the forward portion of the elongated cover member comprises a bottom surface that contacts the desired surface, the bottom surface compressed against the desired surface when the first and second nuts are threadily engaged to the first and second bolts.

7. The organizer of claim 1 wherein the forward portion of the elongated cover member comprises a curved top surface forming a well.

8. The organizer of claim 1 wherein the first and second bolts are elevator bolts having a slotted top surface.

9. The organizer of claim 1 further comprising a plurality of retainers for securing the rods to the first and second supports, the plurality of rods including at least one groove for mating with the one of the plurality of retainers.

10. The organizer of claim 1 further comprising an organization accessory having a pair of hooks for hanging the accessory from one or more of the rods.

11. The organizer of claim 10 wherein each of the hooks comprises a vertical portion that contacts at least two of the rods, thereby supporting the accessory in a substantially horizontal orientation from the rods.

12. The organizer of claim 10 wherein the accessory is selected from a group consisting of a tray and a cup holder.

13. An organizer to be secured to a desired surface having an extending portion comprising:

a base assembly comprising:

a clamping member having a channel and a pair of threaded holes forming passageways into the channel;

the extending portion of the desired surface slidably inserted into the channel of the clamping member;

a pair of bolts theadily engaging the threaded holes and extending into the channel so as to compress the extending portion of the desired surface between the clamping member and the pair of bolts;

a cover member having a rear portion, a forward portion and a channel in the rear portion, the cover member positioned atop the desired surface so that a portion of the clamping member nests within the channel of the cover member and the forward portion rests atop the desired surface so as to provide support that prevents the organizer from leaning forward, top portions of the bolts extending through holes in the cover member and protruding upward from the cover member;

a rack assembly comprising a pair of vertical spaced-apart supports and a plurality of horizontal rods extending between and supported by the pair of vertical supports, the plurality of rods arranged in a spaced-apart manner;

the rack assembly connected to the base assembly and extending upward from the cover member;

a pair of nuts threadily engaged to the top portions of the bolts that fasten the cover member and the clamping member together; and wherein when the pair of nuts are tightened to fasten the cover member and the clamping member together, the compression of the extending portion of the desired surface between the elongated clamping member and the first and second bolts is increased.

14. The organizer of claim 13 wherein the pair of threaded holes of the clamping member are formed by a pair of nuts welded to the clamping member.

15. The organizer of claim 13 wherein when the pair of nuts are tightened to fasten the cover member and the clamping member together, the forward portion of the cover member is compressed against the desired surface.

16. The organizer of claim 13 wherein the pair of supports further comprise an offset member that is substantially parallel to and offset from the vertical member, the offset members extending over sides of the cover member.

17. The organizer of claim 13 wherein the forward portion of the cover member comprises a curved top surface forming a well.

18. The organizer of claim 13 further comprising:

an organization accessory having a pair of hooks for hanging the accessory from one or more of the rods;

wherein each of the hooks comprises a vertical portion that contacts at least two of the rods, thereby supporting the accessory in a substantially horizontal orientation from the rods; and wherein the accessory is selected from a group consisting of a tray and a cup holder.

19. An organizer to be secured to a desk surface having an extending portion comprising:

a base assembly comprising:

at least one clamping member having a channel and a threaded hole forming a passageway into the channel;

the extending portion of the desk surface slidably inserted into the channel of the clamping member;

a bolt theadily engaging the threaded hole and extending into the channel of the clamping member so as to secure the clamping member against the extending portion of the desk surface;

a cover member having a rear portion, a forward portion and a cavity in the rear portion, the cover member positioned atop the desk surface so that a portion of the clamping member nests within the cavity of the cover member and the forward portion rests atop the desk surface, a top portion of the bolt extending through a hole in the cover member;

a rack assembly comprising a pair of vertical spaced-apart supports and a plurality of horizontal rods extending between and supported by the pair of vertical supports, the plurality of rods arranged in a spaced-apart manner;

the rack assembly connected to the base assembly and extending upward from the cover member; and a nut threadily engaged to the top portion of the bolt that; (1) compresses the forward portion of the cover member against the desk surface so as to provide support that prevents the organizer from leaning forward; and (2) further secures the clamping member against the extending portion of the desk surface.

* * * * *